US008622654B2

(12) United States Patent
Oliveira

(10) Patent No.: US 8,622,654 B2
(45) Date of Patent: Jan. 7, 2014

(54) GEOMEMBRANE ANCHOR SYSTEM

(75) Inventor: Paul Oliveira, Carmel, IN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 157 days.

(21) Appl. No.: 13/215,484

(22) Filed: Aug. 23, 2011

(65) Prior Publication Data

US 2012/0045286 A1 Feb. 23, 2012

Related U.S. Application Data

(60) Provisional application No. 61/375,918, filed on Aug. 23, 2010.

(51) Int. Cl.
*E02B 5/02* (2006.01)

(52) U.S. Cl.
USPC ..... 405/129.75; 405/129.6; 405/129.45; 405/270

(58) Field of Classification Search
USPC ..... 405/129.45, 129.55, 129.6, 129.75, 405/129.9, 129.95, 259.1, 302.4, 302.7, 270
See application file for complete search history.

(56) References Cited

U.S. PATENT DOCUMENTS

| | | | | | |
|---|---|---|---|---|---|
| 2,260,111 | A | | 10/1941 | Caldwell et al. | |
| 3,280,082 | A | | 10/1966 | Natta et al. | |
| 4,632,602 | A | * | 12/1986 | Hovnanian | 405/129.8 |
| 4,678,375 | A | | 7/1987 | Gagle et al. | |
| 4,732,925 | A | | 3/1988 | Davis | |
| 4,810,565 | A | | 3/1989 | Wasitis et al. | |
| 4,917,537 | A | * | 4/1990 | Jacobson | 405/129.75 |
| 5,054,327 | A | | 10/1991 | Gould | |
| 5,162,436 | A | | 11/1992 | Davis et al. | |
| 5,175,966 | A | * | 1/1993 | Remke et al. | 405/259.1 |
| 5,204,148 | A | | 4/1993 | Alexander et al. | |
| 5,242,970 | A | | 9/1993 | Davis et al. | |
| 5,248,220 | A | * | 9/1993 | Rohringer | 405/129.5 |
| 5,256,228 | A | | 10/1993 | Davis et al. | |
| 5,286,798 | A | | 2/1994 | Davis et al. | |
| 5,325,642 | A | * | 7/1994 | Cooley | 405/129.57 |
| 5,370,755 | A | | 12/1994 | Davis et al. | |
| 5,389,715 | A | | 2/1995 | Davis et al. | |
| 5,512,118 | A | | 4/1996 | Davis et al. | |
| 5,582,890 | A | | 12/1996 | Davis et al. | |
| 5,700,538 | A | | 12/1997 | Davis et al. | |
| 5,806,252 | A | | 9/1998 | Scuero | |
| 5,854,327 | A | | 12/1998 | Davis et al. | |
| 6,237,289 | B1 | | 5/2001 | Jewett et al. | |
| 6,612,779 | B1 | * | 9/2003 | Scuero | 405/302.7 |
| 6,951,438 | B2 | * | 10/2005 | Carpenter | 405/302.6 |
| 7,207,742 | B2 | * | 4/2007 | Prevost | 405/302.7 |
| 7,374,059 | B2 | * | 5/2008 | Morgan et al. | 220/216 |
| 7,695,219 | B2 | * | 4/2010 | Carpenter | 405/302.7 |
| 7,789,594 | B2 | | 9/2010 | Stahm | |
| 2008/0069642 | A1 | * | 3/2008 | Ayers et al. | 405/129.45 |

* cited by examiner

*Primary Examiner* — Frederick L Lagman
(74) *Attorney, Agent, or Firm* — Jason A. Houser; Arthur M. Reginelli

(57) ABSTRACT

A containment system includes a geomembrane liner positioned over a ground surface. An anchor member is provided beneath the geomembrane liner and includes a fastening plate adapted to be secured to the geomembrane liner. The geomembrane liner is positioned over the ground surface and anchor member and is secured to the fastening plate. Dirt or other covering material may then be provided in the hole and over the geomembrane, or the geomembrane may be left exposed.

27 Claims, 4 Drawing Sheets

GEOMEMBRANE ANCHOR SYSTEM

This Application claims priority of U.S. Provisional Application Ser. No. 61/375,918 filed Aug. 23, 2010, which is incorporated herein by reference in its entirety.

FIELD OF THE INVENTION

One or more embodiments of the present invention relate to a method and system for anchoring a geomembrane liner. More particularly, one or more embodiments of the present invention relate to a method and system of anchoring a geomembrane liner by providing an anchor member in the ground and then securing the geomembrane liner to the anchor member.

BACKGROUND OF THE INVENTION

Geomembrane lining systems are used for a variety of decorative and containment applications, including ponds for both commercial and residential uses, waterfalls, streams, irrigation canals, storm water retention ponds, agricultural pits and ponds, and landfill covering systems. Geosynthetic liner systems offer a number of advantages over alternative liners, including, for example, secure water containment, enhanced water quality control, cleaning and disinfection capabilities, erosion protection, gas permeability, rapid and easy installation, low maintenance costs, long life, and easy repairs.

Geomembrane liners G are conventionally installed using trenches T to secure the liner in position, as shown in FIG. 1. In the case of a pond or canal, the liner may be positioned in the recess or channel that will contain the water, and extend over the bank and into a trench that extends around the periphery of the recess. In the case of landfill covering systems, as depicted in FIG. 1, trenches may be dug in the soil S that covers the trash X. After the geomembrane liner G has been positioned in the trench, dirt or other filler D is provided over the membrane to fill the trench T, thereby preventing the geomembrane liner from further movement.

In many instances, due to concerns relating to movement and uplift of the geomembrane, anchor trenches must be dug to a depth of between 4 and 5 feet in order to adequately secure the geomembrane liner in place. In addition to being labor intensive and time consuming, digging trenches of this depth in landfill covering installations may also be complicated by a lack of adequate dirt covering the garbage and trash contained within the landfill. In these cases, where less than 4 or 5 feet of covering soil has been provided over the landfill, the trenches will unearth the garbage and trash that the covering system is designed to contain. However, shallower anchor trenches may be ineffective at maintaining the geomembrane liner in the desired position.

Another disadvantage associated with trench anchor systems is that dirt or other filler must be provided over the membrane and in the trench to anchor the membranes. Stated differently, it is not possible to leave the geomembrane entirely exposed when a trench anchor system is used. This results in reduced volume of trash stored within a landfill, and makes repairing the geomembrane difficult.

Thus, there is a need for a method and system of anchoring geomembrane liners to resist relatively high uplift forces while not requiring the digging of deep trenches.

SUMMARY OF THE INVENTION

One or more embodiments of the present invention provide a containment system including an anchor member positioned substantially below a ground surface; and a geomembrane liner positioned over the ground surface and the anchor member, the geomembrane liner being secured to the anchor member.

One or more embodiments of the present invention also provides a containment system including a geomembrane liner positioned over a ground surface including at least one hole; an anchor member positioned substantially within the hole and having a top surface positioned proximate to the ground surface; and a fastening plate secured to the top surface of the anchor member and including a heat weldable material on a surface thereof, wherein the geomembrane liner is welded to the heat weldable material of the fastening plate.

One or more embodiments of the present invention also provides a method of installing a containment system including the steps of positioning an anchor member substantially below a ground surface, the anchor member including a fastening plate; positioning a geomembrane liner over the anchor member and in contact with the fastening plate; and securing the geomembrane liner to the fastening plate.

DETAILED DESCRIPTION OF THE ILLUSTRATIVE EMBODIMENTS

One or more embodiments of the present invention are directed toward a geomembrane lining system that covers a ground surface. In certain embodiments, the geomembranes are a component of a water containment system. In other embodiments, the geomembranes are part of a hazardous waste or landfill containment system. It should be appreciated, however, that the anchoring system of the present invention may be used in conjunction with any geomembrane containment system. In one or more embodiments, an anchor member may be provided in a hole with a top surface exposed in the ground surface, and a geomembrane may be secured to the anchor member to retain the membrane in a desired location and position. In certain embodiments, dirt or other covering material may then be provided over the geomembrane to further secure the geomembrane in place. In other embodiments, the geomembrane may be left exposed.

Figure 1:
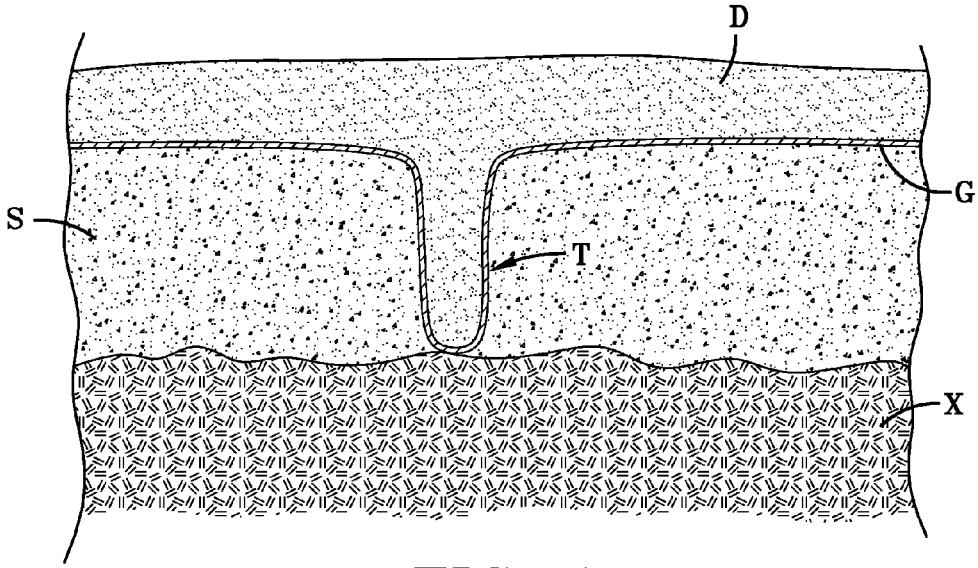
FIG-1 PRIOR ART
FIG. 1 is a schematic view of a prior art geomembrane anchoring system.
Figure 2:
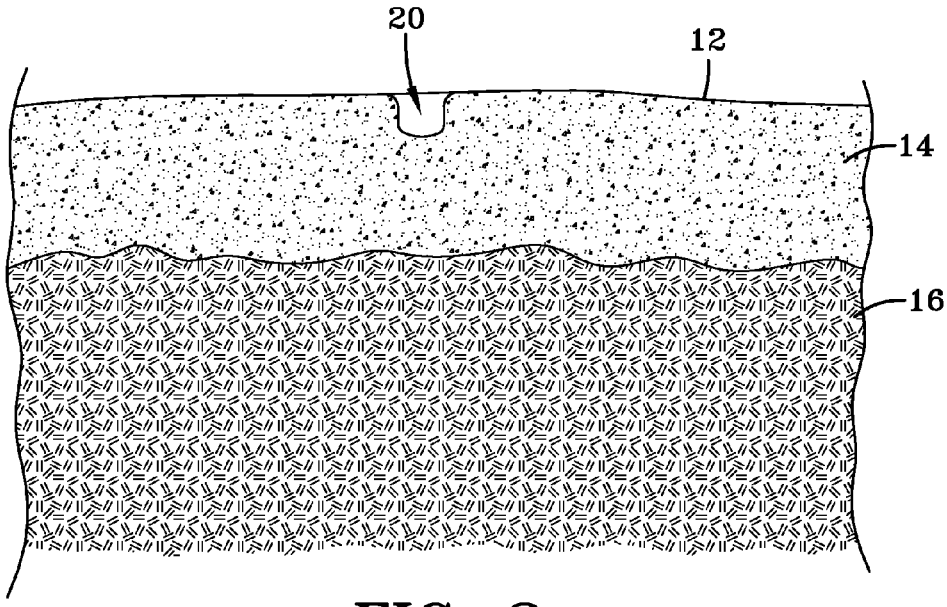
FIG. 2 is a schematic view of a ground surface having a hole to receive an anchor member according to the concepts of the present invention.
Figure 3:
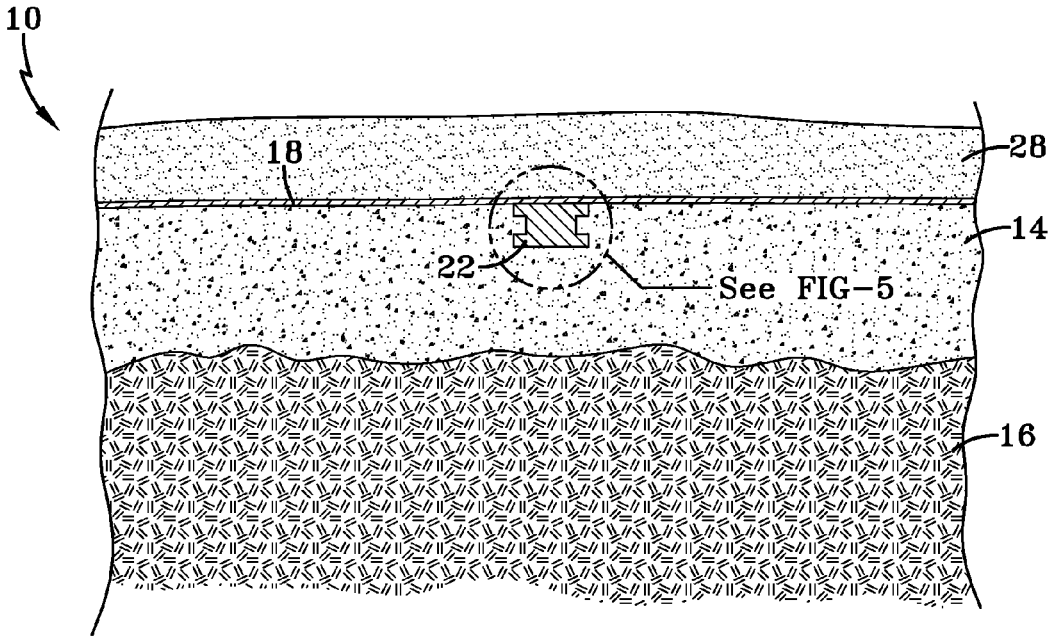
FIG. 3 is a schematic view of a geomembrane installed over the ground surface of FIG. 2 according to the concepts of the present invention.

A geomembrane containment system according to one or more embodiments of the present invention is shown in FIG. 2-5 and is generally indicated by the numeral 10. The containment system 10 includes a ground surface 12 that, prior to installation of the containment system, forms the upper-most exposed layer of an area. In the case of a landfill, and as shown in FIG. 2, ground surface 12 is the upper-most exposed area of a layer of dirt or soil overfill 14 that is provided over the trash or garbage 16 that fills the landfill.

In one or more embodiments, ground surface 12 over which containment system 10 is installed may be generally level. In other embodiments, ground surface may include a low grade slope. In still other embodiments, ground surface 12 may include a steep slope. In yet other embodiments, ground surface 12 may include a basin or recess in which water may be retained to form a pond or reservoir. In each case, the installation and anchoring of the containment system according to the concepts of the present invention is substantially the same.

Prior to placement of a geomembrane liner 18 over ground surface 12, at least one hole 20 is created in overfill layer 14. Hole 20 may be created by any method or mechanism known to those skilled in the art, and may be of any desired size. In one or more embodiments, the hole 20 may be less than approximately 4 feet in depth. In other embodiments, the hole 20 may be less than approximately 3 feet in depth. In still other embodiments, the hole 20 may be between approximately 2 and 3 feet in depth. In a preferred embodiment, the hole 20 is provided with a depth sufficient to accommodate the anchor member, discussed below, while being shallow enough to position the top surface of the anchor member proximate to ground surface 12. The hole 20 may also be adapted to accommodate multiple anchor members.

While at least one hole 20 is provided in each geomembrane containment system 10, it will be appreciated by those skilled in the art that any number or pattern of holes may be used in order to secure geomembrane liner 18 over ground surface 12. The number, arrangement, and pattern of holes 20, and thus anchor members, provided in a containment system 10 may be impacted and influenced by a number of factors including, for example, the purpose of the containment system (i.e., pond or landfill cover), the soil type, the terrain, local weather patterns, anticipated uplift forces, and any other design considerations.

In one or more embodiments, where containment system 10 is designed to hold water, hole 20 may be provided in the form of a trench around the perimeter of a basin or recess in which the water will be retained. In other embodiments, a plurality of holes 20 may be spaced around the perimeter of the basin or recess. In one or more embodiments, where containment system 10 is installed over a landfill, holes 20 may be provided in the form of trenches around the perimeter of the area, as well as in spaced parallel arrangement across the surface area of the area to be covered. In other embodiments, a plurality of holes 20 may be spaced across the surface of the area to be covered. It is also contemplated that holes 20, and the anchor members 22, therein may be strategically positioned at locations of high uplift forces.

Practice of the present invention is not necessarily limited by the selection of a particular geomembrane. The geomembrane, which may also be referred to as a geomembrane liner, may include any of those geomembranes currently employed in the art. In one or more embodiments, geomembrane 18 may be a thermoset material. In other embodiments, geomembrane 18 may be a thermoplastic or thermoformable material.

In one or more embodiments, geomembrane 18 may be EPDM (ethylene-propylene-diene-terpolymer) based. In other embodiments, geomembrane liner 18 may be TPO (thermoplastic-olefin) based. In yet other embodiments, geomembrane liner 18 may be PVC (polyvinyl chloride) based. In still other embodiments, geomembrane 18 may be a polypropylene-based sheet. In these or other embodiments, the geomembrane may be flexible and capable of being rolled up for shipment. In certain embodiments, the geomembrane may include fiber reinforcement. Membrane reinforcement materials are well known to persons having ordinary skill in the art.

Useful EPDM geomembranes include those that are conventional and commercially available in the art. For example, EPDM geomembranes are commercially available under the trade name "Pond Gard" from Firestone Specialty Products Company, LLC (Carmel, Ind.). Also, EPDM geomembranes are disclosed in numerous United States patents including U.S. Pat. Nos. 3,280,082, 4,732,925, 4,810,565, 5,162,436, 5,2 86,798, 5,370,755, 5,242,970, 5,512,118, 2,260,111, 5,256,228, 5,582,890, 5,204,148, 5,389,715, 5,854,327, 5,054,327, and 5,700,538, which are incorporated herein by reference for the purpose of teaching suitable geomembranes for the pond lining system of the present invention. Useful TPO membranes are available under the trade name "Firestone TPO GEOMEMBRANE" (Firestone Specialty Products). Useful flexible polypropylene sheets are available under the trade name "Firestone fPP-R GEOMEMBRANE" (Firestone Specialty Products).

In one or more embodiments, an anchor member 22 is positioned at or near the bottom of the hole 20 prior to placement and positioning of geomembrane liner 18. Anchor member 22 may be in any desired form of shape so long as it provides sufficient weight to resist movement of geomembrane liner 18 and the uplift forces acting thereon. Once placed in hole 20, anchor member 22 is back-filled so that it is positioned within the ground and so that top surface 25 is positioned proximate to ground surface 12 and exposed through ground surface 12.

Figure 4:
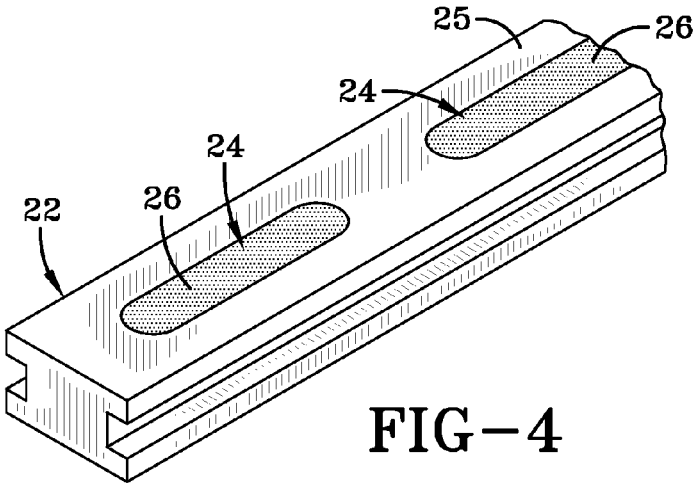
FIG. 4 is a perspective view of an anchor member including fastening plates according to the concepts of the present invention.
Figure 5:
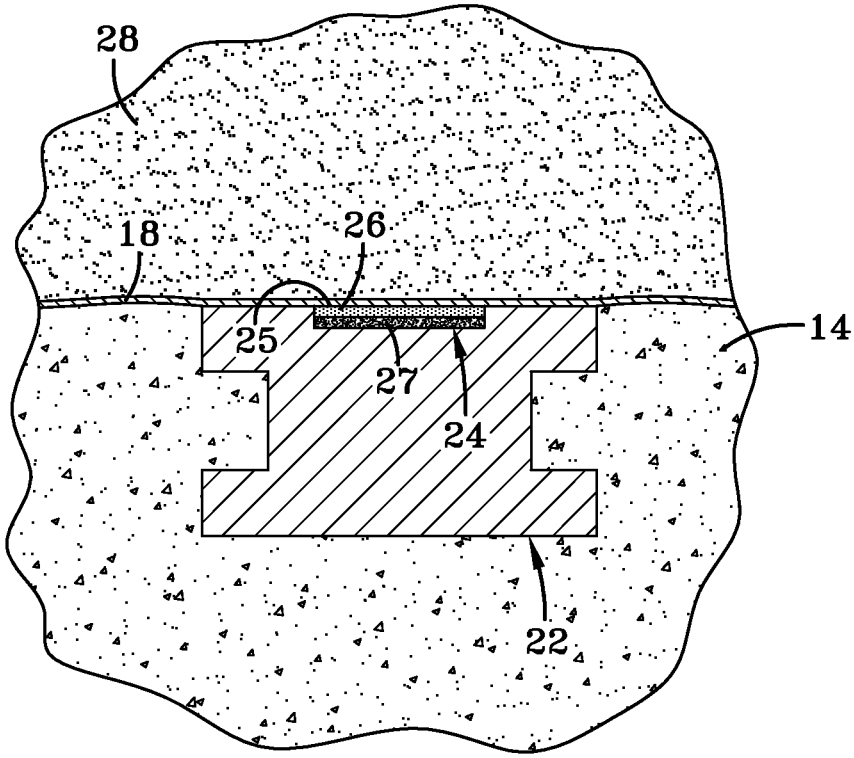
FIG. 5 is an enlarged view of the anchor member and geomembrane as indicated in FIG. 3.

In one or more embodiments, anchor member 22 may have a generally I-shaped cross-section and may be provided in the form of a beam as shown in FIG. 4. In these or other embodiments, anchor member 22 may be provided in segments that are joined end to end to cover substantially all of the bottom surface of a trench 20. In still other embodiments, anchor member 22 may be provided in the form of columns (not shown) having a top surface exposed at the ground surface 12, and a length extending vertically downward into hole 20 in overfill layer 14. Although several examples are provided herein, the invention should not be limited to any specific type or configuration of anchor member 22, unless so claimed.

In one or more embodiments, anchor member 22 may be made of concrete. In these embodiments, anchor member 22 may be preformed, or may be formed on site within hole 20. It is also contemplated that an anchor member 22 formed on-site may be continuous along the length of a hole 20. In other embodiments, anchor member may be made of any suitable material known to those skilled in the art, such as, for example, steel or other metals.

Anchor member 22 may include one or more fastening plates 24 on a top surface 25 thereof. Fastening plate 24 is secured to anchor member 22 and includes a mechanism for securing geomembrane liner 18 thereto. Fastening plate 24 may be secured to anchor member 22 by any method or mechanism known to those skilled in the art, such as, for example, by using mechanical fasteners. In other embodiments, fastening plate 24 may be set into an uncured concrete anchor member 22 and thereby formed integrally with the anchor member. In one or more embodiments, fastening plate 24 may extend continuously along the top surface 25. In other embodiments, a plurality of fastening plates 24 may be spaced along the top surface 25 of anchor member 22.

In one or more embodiments, fastening plate 24 may be a double sided adhesive layer. In other embodiments, fastening plate 24 may be a metal plate having apertures therethrough to receive mechanical fasteners. In still other embodiments, fastening plate 24 may include a substrate 27 and a top layer 26. The substrate 27 may be any material capable of providing strength and rigidity to the fastening plate 24, such as, for example, steel. Top layer 26 may be an adhesive or a heat weldable material.

Geomembrane liner 18 may be secured to fastening plate 24 by any method or mechanism known to those skilled in the art. Where a heat weldable layer is provided on fastening plate 24, geomembrane 18 may be heat welded thereto. After positioning geomembrane liner 18 over anchor member 22 and fastening plate 24, heat may be applied from the top surface of geomembrane liner 18 to secure the liner to heat weldable layer 26. In one or more embodiments, the geomembrane liner 18 may be welded to adhesive layer 26 by an induction welding tool. Where a pressure sensitive adhesive is provided on fastening plate 24, geomembrane 18 may be secured thereto by applying pressure from above.

In one or more embodiments, dirt or other covering 28 may be provided and over membrane 18 to further secure it in place. Covering 28 may include any desired material known to those skilled in the art and suitable for providing ground cover and for anchoring membrane 18. In certain embodiments, covering 28 may be dirt. In these or other embodiments, covering 28 may be the same material as overfill 14. In one or more embodiments, containment system 10 may be devoid of any covering 28 over membrane 18, thereby leaving substantially all of geomembrane liner 18 exposed. An exposed containment system 10 may be used in a variety of ways such as, for example, a location for a field of solar panels.

Figure 6:
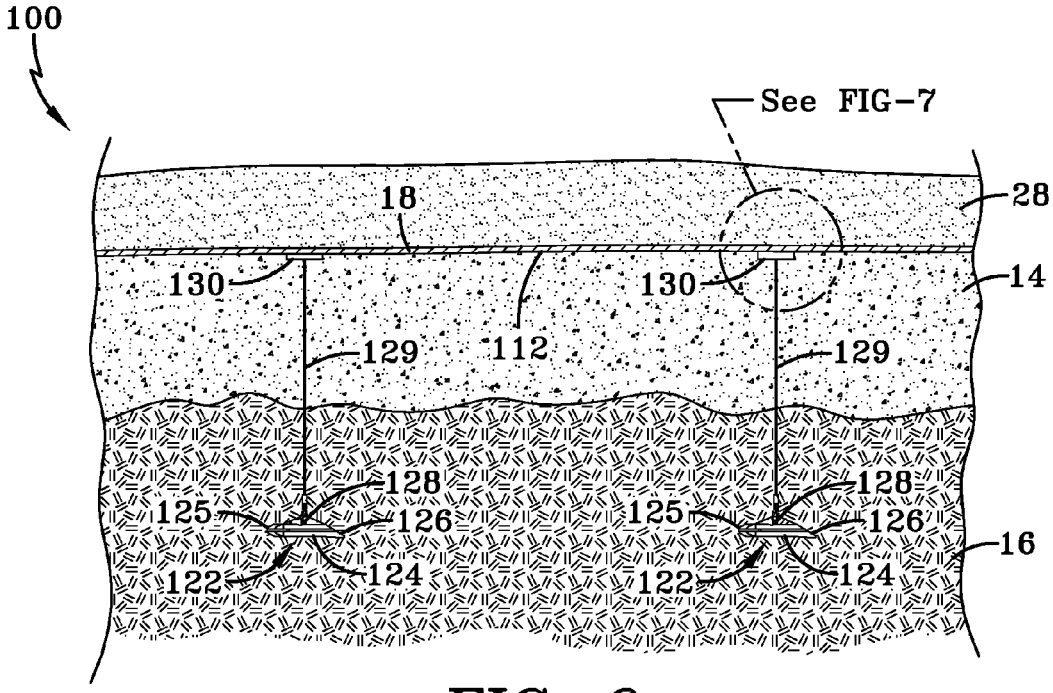
FIG. 6 is a schematic view of an alternative embodiment of the geomembrane anchoring system according to the concepts of the present invention.
Figure 7:
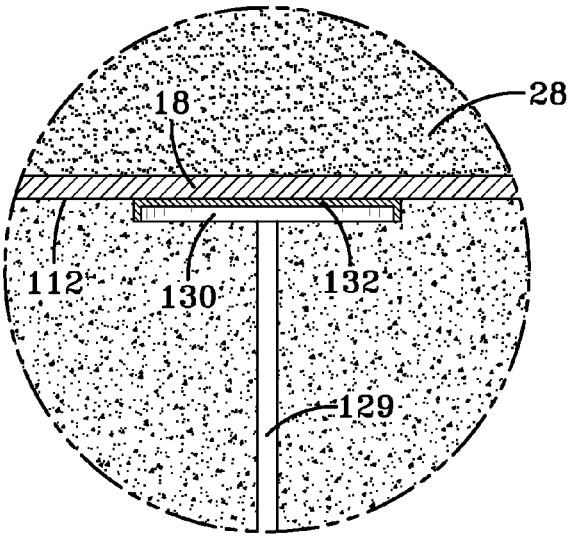
FIG. 7 is an enlarged view of an anchor plate and geomembrane liner as indicated in FIG. 6.

An alternative embodiment of a containment system according to the concepts of the present invention is shown in FIGS. 6-7 and is indicated generally by the numeral 100. Containment system 100 is similar in most respects to containment system 10 but includes an alternative anchoring member 122.

The anchor member 122 is provided to secure the geomembrane 18 over the ground surface 12 and prevent any substantial movement thereof. Anchor member 122 is a ground anchor including a main body portion 124 having a leading edge 125 adapted to be driven into the ground, a trailing edge 126 with an outturned lip, and an attachment point 128 intermediate the leading edge 125 and trailing edge 126. The anchor member also includes a cable, rod, or guide wire 129, hereinafter collectively referred to as a cable, secured at one end to the attachment point 128 and at an opposite end adjacent to ground surface 12 to a fastening plate 130.

After the body portion 124 has been driven into the ground, pressure applied to the cable causes the outturned lip to engage the surrounding soil, thereby causing the body portion to rotate. Once rotated, the body portion of the ground anchor resists removal, even under high forces applied to the cable, such as by wind uplift forces acting upon a geomembrane liner. The cable 129 may be secured to the attachment point 128 and the fastening plate 130 by any method or mechanism known to those skilled in the art. Similar ground anchors suitable for use in the present invention are known to those skilled in the art, and are described in greater detail in U.S. Pat. Nos. 7,789,594 and 6,237,289, both of which are incorporated herein by reference.

The fastening plate 130 is adapted to be secured to geomembrane liner 118, thereby anchoring the geomembrane liner against movement any substantial movement relative to ground surface 12. In one or more embodiments, fastening plate 130 may include an adhesive tape on a top surface thereof, the adhesive tape adapted to adhere to the geomembrane liner 18. In other embodiments, fastening plate 130 may be a metal plate having an aperture therethrough to receive mechanical fasteners extending through geomembrane liner 18. In certain embodiments, a flashing patch (not shown) may be positioned over the mechanical fasteners.

In still other embodiments, fastening plate 130 may include a coating 132. In one or more embodiments, the coating 132 may be a heat weldable material covering at least the top of the substrate. In containment systems including a thermoplastic or heat weldable geomembrane liner 18, the heat weldable coating 132 allows for heat welding of the geomembrane liner 18 to the fastening plate 130. As an example, the Ultra-Ply TPO Invisiweld Plates commercially available from Firestone Building Products, which are intended for use in TPO roofing systems, may be used as fastening plates 130 in containment system 100. The Invisiweld Plates are coated with TPO to allow heat welding of thermoplastic roofing membranes to be heat welded to the plates. The plate 130 may be made of any material providing strength and rigidity such as, for example, galvanized metal. While the Invisiweld Plates from Firestone Building Products are references as a suitable example of a fastening plate 130, it should be appreciated that fastening plates 130 may be provided in a variety of shapes and sizes, and with any known heat weldable material as the coating.

In use, the anchor members 122, or ground anchors, are first driven into the ground using conventional techniques so that the fastening plates 130 are positioned approximately at the ground surface 12. The geomembrane liner 18 may then be positioned over the fastening plates 130, and the geomembrane liner 18 may then be secured to the fastening plates 130 from the top surface of the liner. In a containment system where mechanical fasteners are used to secure the geomembrane liner 18 to the fastening plate 130 the fasteners may be driven into the fastening plate 130 from the top of the geomembrane liner. In the case of fastening plates having adhesive thereon, pressure may be applied to the top surface of the geomembrane liner 18 at the locations of the fastening plates 130. In the case of fastening plates having a heat weldable coating, an induction welding tool may be used to heat weld the geomembrane liner 18 to the fastening plate 130.

An anchoring system and method as described herein may provide improved performance in a geomembrane liner system, while also reducing the time and labor involved in site preparation. Furthermore, the anchoring system of the present invention may allow for secure and stable installation of geomembrane liner systems in locations where installation would not be possible using prior art methods. The system and method of the present invention also allow for an exposed geomembrane liner, where desired.

Various modifications and alterations that do not depart from the scope and spirit of this invention will become apparent to those skilled in the art. This invention is not to be unduly limited to the illustrative embodiments set forth herein.

What is claimed is:

1. A containment system comprising:

an anchor member positioned substantially below a ground surface; and a geomembrane liner positioned over the ground surface and the anchor member, the geomembrane liner being secured to the anchor member, wherein a longitudinally extending trench receives a plurality of anchor members therein, the anchor members being arranged end to end within the trench.

2. The containment system of claim 1, further comprising a fastening plate attached to both said anchor member and said geomembrane liner to secure said geomembrane liner to said anchor member.

3. The containment system of claim 2, wherein said anchor member includes a top surface, said top surface being generally flush with said ground surface.

4. The containment system of claim 2, wherein said fastening plate includes an adhesive layer, and said geomembrane liner is secured to said adhesive layer.

5. The containment system of claim 2, wherein said geomembrane liner is secured to the fastening plate by mechanical fasteners, the fastening plate including an element to receive a mechanical fastener.

6. The containment system of claim 2, wherein said fastening plate includes a heat weldable material, and said geomembrane liner is heat welded to said fastening plate.

7. The containment system of claim 2, wherein said anchor member includes a main body portion having a leading edge adapted to be driven into the ground, a trailing edge with an outturned lip, and an attachment point located intermediate of the leading edge and trailing edge.

8. The containment system of claim 7, wherein said anchor member further includes a cable extending between said main body portion and said fastening plate.

9. The containment system of claim 1, wherein said anchor member is made of concrete.

10. The containment system of claim 1, wherein said geomembrane liner is made of a heat weldable material.

11. The containment system of claim 1, wherein said geomembrane liner is a thermoset membrane.

12. The containment system of claim 1, wherein a plurality of spaced anchor members are provided, each anchor member including at least one fastening plate.

13. A containment system comprising:

a geomembrane liner positioned over a ground surface including at least one hole;

an anchor member positioned substantially within the hole and having a top surface positioned proximate to the ground surface; and a fastening plate secured to the top surface of the anchor member and including a heat weldable material on a surface thereof, wherein the geomembrane liner is welded to the heat weldable material of the fastening plate.

14. A method of installing a containment system comprising;

positioning an anchor member substantially below a ground surface, the anchor member including a fastening plate;

positioning a geomembrane liner over the anchor member and in contact with the fastening plate; and securing the geomembrane liner to the fastening plate, wherein the step of securing the geomembrane liner to the fastening plate includes one of heat welding the geomembrane liner and a layer of heat sensitive adhesive on the fastening plate, or using an induction welding tool to weld the geomembrane liner to the fastening plate.

15. The method of claim 14, further comprising the steps of digging a hole prior to positioning the anchor member, and back filling the hole after the anchor member has been positioned therein.

16. The method of claim 15, wherein the step of digging a hole includes digging a plurality of holes, and wherein an anchor member is positioned in each hole.

17. The method of claim 15, wherein the hole is a trench, and a plurality of anchor members are positioned in the trench.

18. A containment system comprising:

an anchor member positioned substantially below a ground surface; a fastening plate attached to said anchor member; and a geomembrane liner positioned over the ground surface and the anchor member, the geomembrane liner being secured to the anchor member by said fastening plate, wherein said fastening plate includes either an adhesive layer such that said geomembrane liner is secured to said adhesive layer, or a heat weldable material such that said geomembrane liner is heat welded to said fastening plate.

19. The containment system of claim 18, wherein said anchor member includes a top surface, said top surface being generally flush with said ground surface.

20. The containment system of claim 18, wherein said anchor member is made of concrete.

21. The containment system of claim 18, wherein a longitudinally extending trench receives a plurality of anchor members therein, the anchor members being arranged end to end within the trench.

22. The containment system of claim 18, wherein said geomembrane liner is made of a heat weldable material.

23. The containment system of claim 18, wherein said geomembrane liner is a thermoset membrane.

24. The containment system of claim 18, wherein a plurality of spaced anchor members are provided, each anchor member including at least one fastening plate.

25. The containment system of claim 18, wherein said geomembrane liner is secured to the fastening plate by mechanical fasteners, the fastening plate including an element to receive a mechanical fastener.

26. The containment system of claim 18, wherein said anchor member includes a main body portion having a leading edge adapted to be driven into the ground, a trailing edge with an outturned lip, and an attachment point located intermediate of the leading edge and trailing edge.

27. The containment system of claim 26, wherein said anchor member further includes a cable extending between said main body portion and said fastening plate.

* * * * *